US006735836B2

(12) United States Patent
Jourde et al.

(10) Patent No.: US 6,735,836 B2
(45) Date of Patent: May 18, 2004

(54) DEVICE FOR ASSEMBLING AND DISASSEMBLING A MACHINE PART, AND NEEDLING LOOM EQUIPPED THEREWITH

(75) Inventors: Bernard Jourde, Paris (FR); François Louis, La Saussaye (FR)

(73) Assignee: Asselin, Elbeuf (FR)

( * ) Notice: Subject to any disclaimer, the term of this patent is extended or adjusted under 35 U.S.C. 154(b) by 34 days.

(21) Appl. No.: 10/257,284

(22) PCT Filed: Apr. 10, 2001

(86) PCT No.: PCT/FR01/01086

§ 371 (c)(1),
(2), (4) Date: Oct. 11, 2002

(87) PCT Pub. No.: WO01/76812

PCT Pub. Date: Oct. 18, 2001

(65) Prior Publication Data

US 2003/0097740 A1 May 29, 2003

(30) Foreign Application Priority Data

Apr. 11, 2000 (FR) ..... 00 04665

(51) Int. Cl.[7] ..... D04H 18/00
(52) U.S. Cl. ..... 28/107; 28/115
(58) Field of Search ..... 28/107, 108, 109, 28/110, 111, 112, 113, 114, 115; 112/80.01, 80.4, 80.44, 80.45; 221/289, 290, 295, 298, 299; 384/8, 10, 57, 59, 20, 21, 22; 29/281.1, 281.3, 281.5; 269/9, 58, 59, 71, 74

(56) References Cited

U.S. PATENT DOCUMENTS

| | | | | |
|---|---|---|---|---|
| 1,650,818 A | * | 11/1927 | Buffington et al. | 29/251 |
| 3,286,338 A | * | 11/1966 | Bohr | 29/446 |
| 3,898,901 A | | 8/1975 | Savage | |
| 4,169,412 A | * | 10/1979 | Stelmasik et al. | 100/257 |
| 4,884,324 A | * | 12/1989 | Stanislaw | 28/107 |
| 4,953,988 A | | 9/1990 | Tsukada | |
| 5,287,604 A | * | 2/1994 | Feyerl | 28/115 |
| 5,509,185 A | | 4/1996 | Petkov | |
| 5,579,695 A | | 12/1996 | Cockayne | |
| 5,699,595 A | * | 12/1997 | Feyerl | 28/107 |
| 6,003,215 A | * | 12/1999 | St. Jacques | 28/115 |
| 6,145,176 A | * | 11/2000 | Egnaczak et al. | 28/107 |
| 6,161,269 A | * | 12/2000 | Dilo et al. | 28/114 |

* cited by examiner

*Primary Examiner*—A. Vanatta
(74) *Attorney, Agent, or Firm*—Young & Thompson

(57) ABSTRACT

A needling loom comprising needles actuated in reciprocating motion between a retracted position and a maximum penetration position through a stripping plate, a textile web to be consolidated, and a needling loom table. The stripping plate and the needling loom table bear rails and elements for rapid assembling and disassembling for either pressing the rails against fixed crosspieces for the needling loom to operate, or for releasing the pressure and cause the rails to rest on rollers for extracting and inserting the stripping plate and the table by simple transverse sliding in the passage direction of the web. The invention is useful for reducing the time for assembling and disassembling machine components such as the stripping plate and a needling loom table for maintenance operations, in particular cleaning operations.

13 Claims, 3 Drawing Sheets

DEVICE FOR ASSEMBLING AND DISASSEMBLING A MACHINE PART, AND NEEDLING LOOM EQUIPPED THEREWITH

This invention relates to a device for the fast assembling and disassembling of a machine part, in particular, but non-limitatively, a plate-shaped part.

This invention also relates to a needling loom equipped therewith for the fast assembly and disassembly of plates such as the stripping plates and/or the needling table, in order to clean them quickly.

Certain machine parts require accurate positioning when they are in service in the machine, but require more or less frequent disassembly for reasons of maintenance, replacement or cleaning.

These operations of disassembly and reassembly require the machine to be stopped. It is therefore particularly important to reduce the duration of this stoppage.

A needling loom conventionally comprises a set of parallel needles actuated in a reciprocating manner in their longitudinal direction in order to penetrate repeatedly through a fibre web in order to consolidate the web by interlacing the fibres composing it. The path of the fibres in the working area of the needles is conventionally defined between two plates pierced with orifices for the needles to pass through. The plate located on the side where the needles are situated when they are in the withdrawn position is called a "stripping plate". It serves to prevent the fibre web from being dragged by the needles during their return motion towards the withdrawn position. The other plate, serving to prevent the fibre web from being pushed by the points of the needles, is called the "needling loom table". These two plates require periodic disassembly in order that the orifices through which the needles pass can be cleared of fibres and other materials that can become lodged in them in an increasing quantity during operation.

So-called "fast" assembly and disassembly devices are known. All of these known devices are more or less ingenious bolting means but which only rarely make it possible to reduce the assembly or disassembly times to less than about one hour and thirty minutes. Such a duration seriously impedes production.

The purpose of the present invention is to propose an assembly and disassembly device that makes it possible to reduce this time considerably, and a needling loom whose plates, such as the stripping plate and/or the needling loom table, are equipped with this device in order to procure improved productivity.

According to a first aspect of the invention, the fast assembly and disassembly device for positioning a machine part in an operating position against support means provided on the machine, and selectively for releasing said part to allow mobility thereof, is characterized by comprising:

- guidance means allowing insertion and extraction of the part into and out of the machine respectively;
- pressers which are movably mounted with respect to the frame of the machine, and capable of moving the part between the operating position and a preparatory position in which the part is interacting with the guidance means; and
- means of simultaneous control of the pressers.

Thanks to the means of control, the pressers can be simultaneously actuated in order to cause movement of the machine part from its operating position to the preparatory position ensuring the interaction with the guidance means. It then suffices to move the machine part along the trajectory defined by the guidance means in order to extract the machine part and to be able to carry out the necessary replacement or maintenance operation. During reassembly, the guidance means make it possible to return the part to the preparatory position. At this stage, the pushers are actuated simultaneously in the direction of returning the part to the operating position. If needed, according to a preferred version of the invention, locking means are also provided in order to stabilise the part in the operating position.

According to a second aspect of the invention, the needling loom comprising:

- a frame;
- a path for a textile product to be needled;
- at least one plate adjacent to a major face of the path;
- at least one set of needles carried by a moving beam connected to an actuating mechanism for reciprocating the needles through the path and through orifices in the plate, is characterized by furthermore comprising at least one device for fast assembly and disassembly of the plate according to the first aspect.

Other features and advantages of the invention will furthermore emerge from the following description, relating to a non-limitative example.

Figure 3:
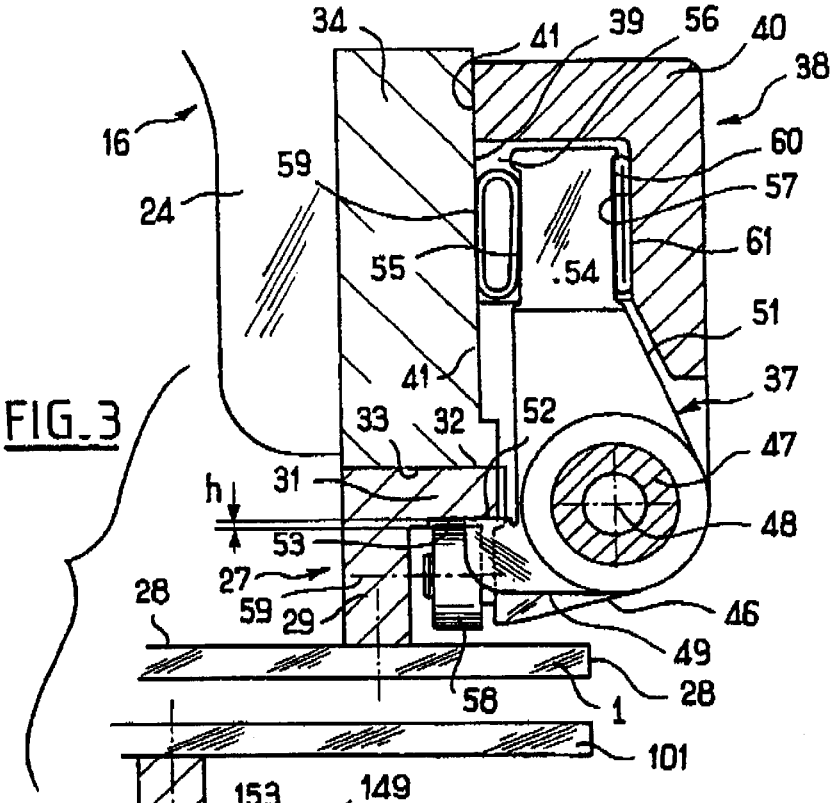
Figure 5:
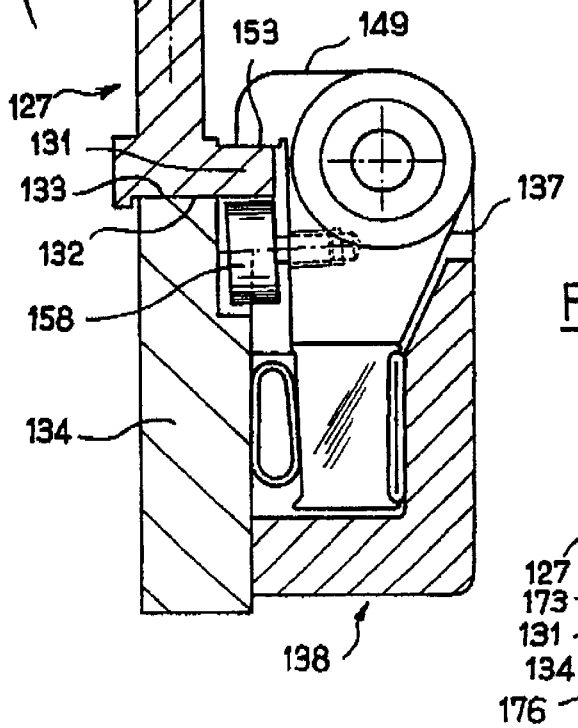
Figure 5:
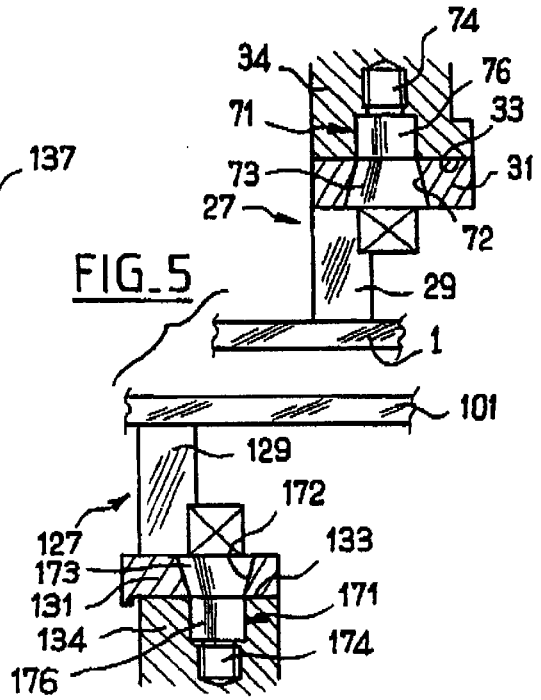
Figure 4:
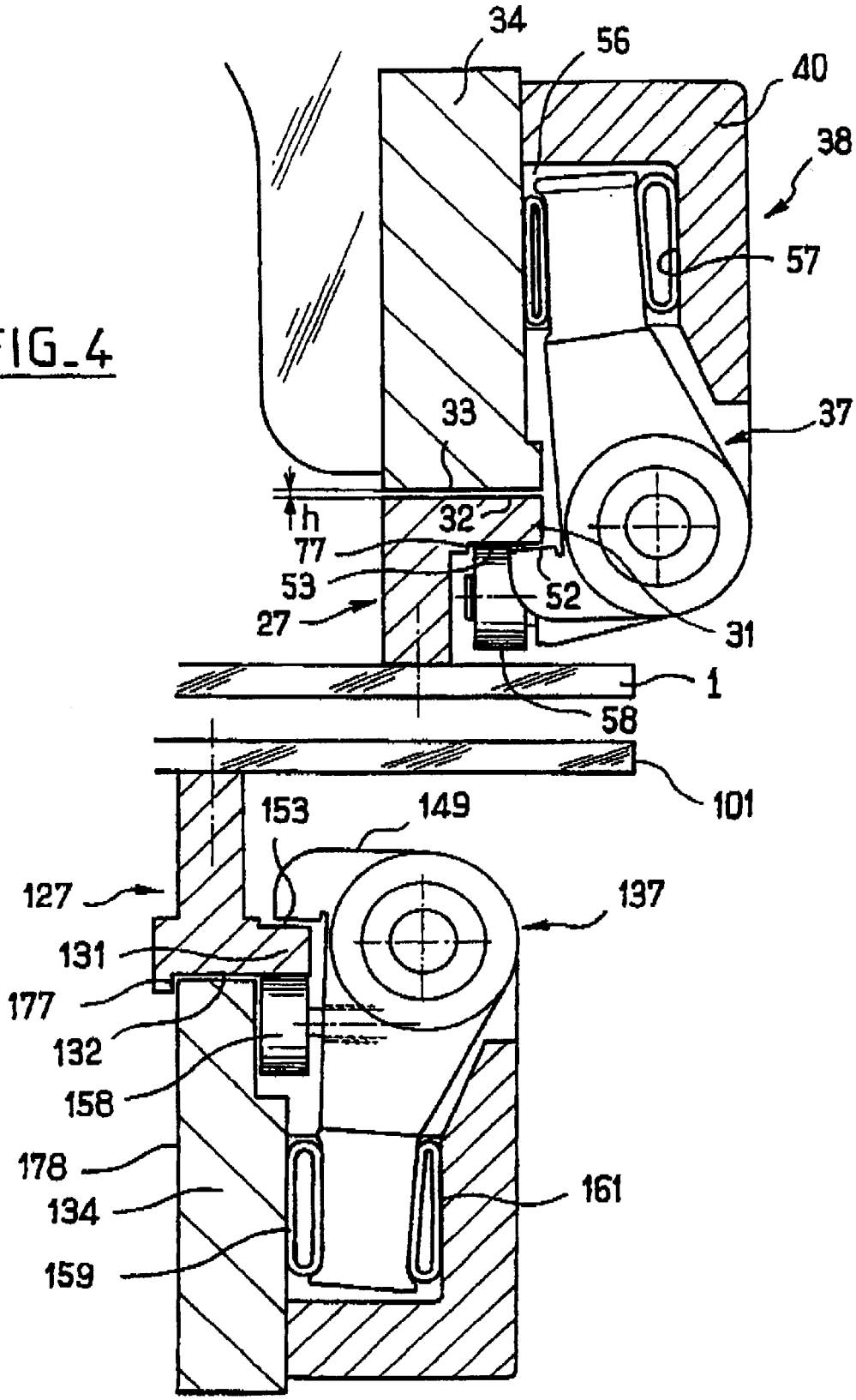

FIGS. 3 and 4 are cross-sectional views, on a larger scale, showing the assembly and disassembly device on one side of the stripping plate and of the needling table, in the state of holding the stripping plate and the table in the operating position (FIG. 3) and, respectively, in the state of making them cooperate with the guidance means (FIG. 4); and FIG. 5 is an end view, in partial cross-section, illustrating the locking means.

Figure 1:
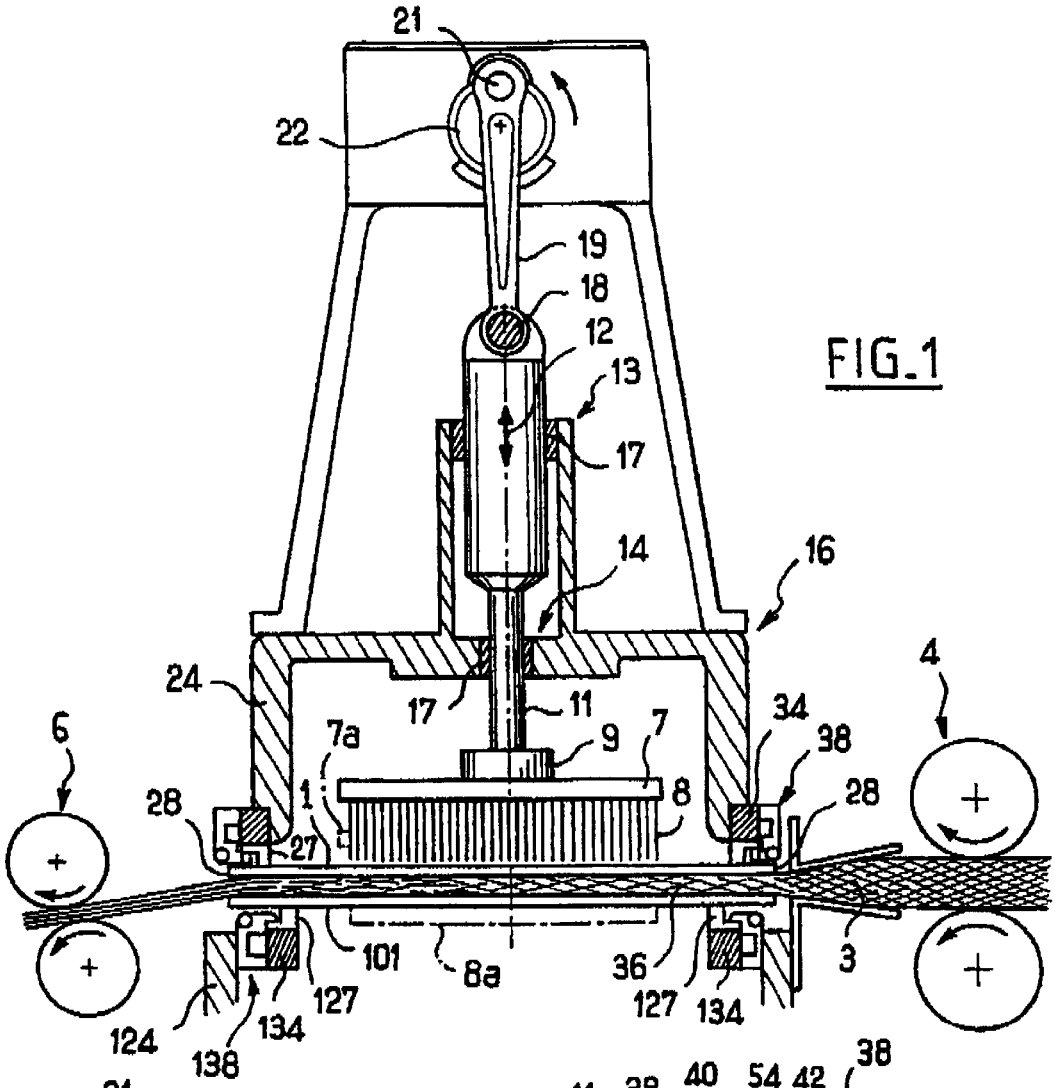
FIG. 1 is a diagrammatic view in elevation, with a partial cross-section, of a needling loom according to the invention.

The needling loom shown in FIG. 1 comprises a generally horizontal perforated table 101 and a holding plate 1, also called a "stripping plate" placed approximately parallel with and a certain distance above the table 101. The stripping plate 1 and the table 101 define between them a path in a substantially horizontal plane for a fibre web 3. The stripping plate 1 comprises perforations aligned with those of the table 101. At the entrance of the path are placed induction means 4, represented diagrammatically in the form of a pair of drive rollers between which the web 3 passes. At the exit of the path, the web 3, consolidated and compacted by the needling, is moved along by extractor means 6, also represented diagrammatically by a pair of drive rollers between which the web passes.

The stripping plate 1 is placed between the path of the web 3 and a needle board 7. The board 7 carries, on the side of the stripping plate 1, a large number of needles 8 oriented perpendicularly with respect to the plane of the path of the web 3, with their points facing towards the web 3. Each needle is positioned facing a perforation in the stripping plate 1 and a corresponding perforation in the table 101. On the side facing away from the needles 8, the needle board 7 is fixed to a support beam 9 that is itself secured to the end of at least one rod 11 which is mounted for sliding along an axis 12, parallel with the needles 8 and perpendicular to the plane of the path of the web 3. If several rods 11 are provided, these are for example aligned one behind the other when they are seen as shown in FIG. 1. For its guidance in sliding, each sliding rod 11 is guided in two axially separated coaxial slide bearings 13 and 14, which are integral with a frame 16 that is only partially shown. The bearings 13 and 14 comprise anti-friction rings 17 for contact with the rod 11.

The moving system consisting of the sliding rod or rods 11, the support beam 9 and the board 7 is driven during operation with a reciprocating motion in the direction 12 between a position 7*a* in which the ends of the needles, indicated in this case by 8*a,* extend through the stripping plate 1, the web 3 and the table 101, and a cleared position, represented in full line, in which the needles 8 are totally clear of at least the table 101 and the web 3, and preferably of the stripping plate 1.

In order to impart this reciprocating motion to the moving system, the rod 11 is articulated by an articulation 18 at one end of a connecting rod 19 whose other end is connected by an articulation 21 to a crankshaft 22 driven in rotation by driving means that are not shown.

Figure 2:
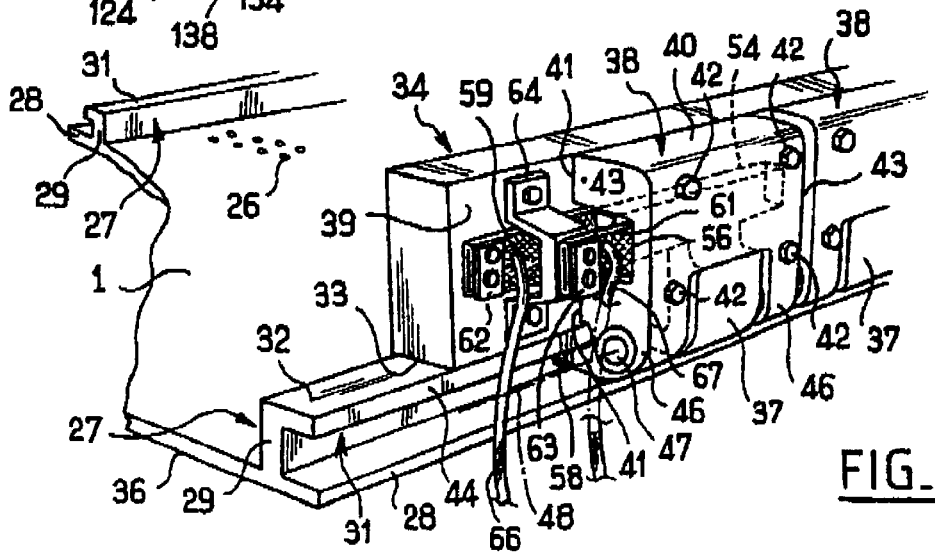
FIG. 2 is a partial perspective view, with a cutaway, showing the means of assembly and disassembly of the stripping plate.

The stripping plate 1 and the table 101 are removably secured to an upper section 24 and respectively to a lower section 124 of the frame 16. FIG. 2 shows, by way of example, the stripping plate 1 of which only a few orifices 26 have been shown for the passage of the needles 8 (not visible in FIG. 2). On its face opposite to that defining the path of the web 3, the stripping plate 1 carries two parallel rails 27 which extend along two opposite edges 28 that are transverse with respect to the direction of progression of the web 3 through the needling loom. The rails 27 have an L-shaped cross-section with a proximal flange 29 extending vertically and perpendicularly with respect to the main plane of the stripping plate 1 starting from its rear face, and a distal flange 31 extending parallel with the rear face of the stripping plate 1 and towards the outside starting from the free end of the proximal flange 29

The distal flange 31 has a flat upper face 32 forming a face for bearing and positioning against a reference face 33 constituted by the lower flat face of a crosspiece 34 integral with the upper section 24 of the frame 16. When the stripping plate 1 is in the operating position in which the orifices 26 are correctly positioned with respect to the needles 8 and its lower face 36 is in a suitable position for defining the path of the web 3, the bearing surface 32 of the rails 27 is firmly applied against the reference face 33 by pressing levers 37 each being part of a fast assembly and disassembly module 38 carried by the outer face 39 of the crosspiece 34.

As shown in FIG. 2, each crosspiece 34 carries modules 38 aligned with virtually no gaps between them substantially over the whole of its length. Each module 38 has a body 40 substantially having a U-shaped profile whose two ends 41 are fixed against the face 39 by screws 42. Along each of its two lateral faces 43, the body of the module is extended downwards beyond the edge 44 of the distal flange 31 of the rail 27 in order to form two lugs 46 supporting a shaft 47, common to the two lugs 46 and parallel with the rail 27. The shaft 47 extends through the pressing lever 37 and pivotably supports the latter about a pivoting axis 48 (see also FIG. 3).

The lever 37 is produced in the form of a lever bent at approximately 90° comprising a presser arm 49 and an actuating arm 51. The presser arm 49 extends towards the proximal flange 29 of the rail 27 whilst passing under the distal flange 31 and comprises a pressing face 52 capable of engaging the lower face 53 of the distal flange 31 in order to press the distal flange 31 into engagement of its upper surface 32 against the reference face 33 of the crosspiece 34. The region of the lever 37 surrounding the shaft 47 and forming the presser arm 49 is located between the two lugs 46 (see FIG. 2). The actuating arm 51 extends upwards and terminates in a paddle 54 extending parallel with the rail 27 in the recess 56 defined by the U-shaped profile of the body 40 of the module 38. The ends of the paddle 54 are substantially in the plane of each lateral face 43 of the body 40. Thus, from one module 38 to another, the levers 37 succeed one another substantially without discontinuity along the paddles 54.

Each lug 46 rotatably supports a roller 58 along an axis 59 which is horizontal and perpendicular to the transverse edges 28 of the stripping plate 1. When the pressing face 52 of the lever 37 is pressed against the rail 27 and keeps the latter bearing against the reference face 33 of the crosspiece 34, there is a play h (FIG. 3), for example 1 mm, between the rollers 58 and the lower face 53 of the distal flange 31. Starting from the pressing position shown in FIG. 3, the lever 37 can pivot about the axis 48 into a release position seen in FIG. 4, in which the pressing face 52 moves downwards and allows the stripping plate 1 to descend by about 1 mm in order to bear upon the rollers 58, the play h thereafter being formed between the upper face 32 of the distal flange 31 and the reference face 33 of the crosspiece 34. The pressing face 52 of the lever 37 is no longer in contact with the rail 27. The stripping plate 1 is then in a preparatory position from which it can be extracted from the needling loom by a simple traction force parallel with the transverse direction of the needling loom, in order to cause the surface 53, forming a rolling surface, of the distal flange 31 to roll on the rollers 58 of the aligned modules 38.

The fast assembly and disassembly device furthermore comprises means of simultaneous actuation of all of the levers 37 associated with the two transverse edges of the stripping plate 1. These means comprise two pneumatic tubes 59, 61, along each row of modules 38. The tube 59 extends between an actuating face 55 of the paddles 54 of the levers 37 and the outer lateral face 39, forming a reactive bearing face. The tube 61 extends between an opposite actuating face 60 of the said paddles 54 and a reactive bearing face formed by the bottom 57 of the recesses 56 of the modules 38. In order to simultaneously place the levers 37 in the pressing position, the two tubes 59 (one along each transverse edge of the stripping plate 1) are inflated pneumatically and the two tubes 61 are allowed to deflate. In order to cause the levers 37 to move simultaneously to the release position, the two tubes 59 are allowed to deflate and the two tubes 61 are inflated. It would be conceivable to dispense with the two tubes 61 and to rely on the weight of the stripping plate 1 for the movement of the lever 37 to the release position but there would be a risk of friction between the pressing faces 52 of the levers 37 and the face 53 of the two rails 27 during the extraction and reinsertion of the stripping plate 1.

FIG. 2 shows a possible arrangement at the end of the tubes 59 and 61 in the vicinity of one of the ends of the crosspiece 34. The tubes 59 and 56 are simple tubes cut to length and made of leak-proof synthetic material reinforced with fibres. The cut end of the tube 59 is obturated by being flattened against the outer face 39 of the crosspiece 34 by a clamping plate 62. The cut end of the tube 61 is obturated by being flattened by a clamping plate 63 against the top of a bridge-shaped part 64 which straddles the tube 59. Two end feet of the part 64 are secured against the lateral face 39 on either side of the tube 59. FIG. 2 also shows the supply connection 66 of the tube 59 and the supply connection 67 of the tube 61.

The forces sustained in operation by the stripping plate 1 are principally directed upwards since the function of the stripping plate 1 is to prevent the textile web from following the needles 8 during their movement of withdrawal. These forces are supported by the reference face 33 of the crosspiece 34. The levers 37 therefore at most have to provide a stabilising force, for example, with respect to vibrations, but do not have to hold the stripping plate 1 against its main operating stress. During operation of the needling loom, the tube 59 remains pneumatically pressurized. In any case, many modern needling looms require a pneumatic supply for various functional devices such as inflatable seals or presser actuators for the rollers of the devices for feeding 4 and extracting 6 the web 3.

A fast assembly and disassembly device for the table 101 will now be described only where it differs from that of the stripping plate 1. The main force to which the table 101 is subjected in operation is directed downwards since it consists in preventing the textile web 3 from being pushed by the points of the needles 8 during their movement of penetration. This is why, the fast assembly and disassembly device for the table 101 is generally symmetrical with that of the stripping plate 1 with respect to the median horizontal plane of the path of the fibres. The bearing face 132 of the rail 127 is thus facing downwards and pressed against an upward-facing reference face 133 or a crosspiece 134 integral with the lower section 124 of the frame 16. In the operating position, the presser arm 149 of the lever 137 bears against the upper face 153 of the rail 127 in order to push the bearing face 133 into engagement with the reference face 132. Each module 138 comprises no more than a single roller 158 rotatably supported by the lever 137 thereby to cooperate with a running surface consisting of the bearing face 132 of the rail 127 (instead of two rollers in a fixed position 58 cooperating with the other face 53 of the rail 27 in the case of the stripping plate 1). In fact, during the assembly and disassembly, the rollers must support the weight of the part (table 101 or stripping plate 1) to be manoeuvred, and the weight is always applied downwards irrespective of the direction of the main operating force. The presser arm 149 and the roller 158 of each lever 137 thus form a sort of fork receiving, with a certain amount of play, the distal flange 131 of the rail 127. In the pressing position, the presser arm 149 engages the flange 131 and there is a play between the roller 158 and the bearing face 132 (FIG. 3).

On the other hand, in the release position (FIG. 4), the rollers 158 engage the bearing surface 132 of the rail 127 from below and raise the table 101 whilst a play is formed between the presser arm 149 and the upper face 153 of the flange 131. The simultaneous control of the levers 137 is carried out as described for the levers 37 by the selective inflation of one tube 159 or 161, and the opening up to the atmosphere of the other of the two tubes.

Furthermore, in the assembly and disassembly device associated with the table 1, the levers 137 can assume the release position only by acting against the weight of the table 101 and it would not therefore be sufficient to simply leave the tube 159 to deflate in order to achieve this position.

As shown in FIG. 5, when the table 101 or the stripping plate 1 is in the operating position, it is preferred to ensure the precision of the positioning by means of pins 71, 171 which screw into a bore formed in the reference face 33, 133 of the crosspiece 34, 134, by extending through a conical bore 72, 172 formed in the distal flange 31, 131 of the rail 27, 127. The conical bore 72, 172 of the rail 27, 127 tapers towards the crosspiece 34, 134 and receives a corresponding truncated cone-shaped part 73, 173 of the pin. Between this truncated cone-shaped section and the thread 74, 174 screwing into the crosspiece 34, 134, the pin has a cylindrical section 76, 176 that is positioned with precision in a smooth entrance, of corresponding diameter, of the bore formed in the crosspiece 34, 134. There is one pin 71 or 171 for each rail 27 or 127, at one of the ends of the latter, where, as can be seen in FIG. 5, the distal flange 31, 131 is extended slightly beyond the proximal flange 29, 129 of the rail. The pins 71, 171 guarantee a precise positioning of the stripping plate 1 and of the table 101 in the operating position with respect to the transverse direction of the needling loom. As the pins 71, 171 are at the end of the rail, and therefore close to one side of the needling loom, they can be extracted very quickly before causing the levers 37, 137 to move into the release position and then extracting the stripping plate 1 or the table 101 respectively.

For the positioning of the stripping plate 1 and of the table 101 along the direction of movement of the fibre web 3 (the direction perpendicular to the rails 27 127), and for the parallelism of the rails 27 with the transverse direction of the needling loom, any guidance means can be provided, for example a shoulder 77 (FIG. 4) provided on the bearing face 53 of the rail 27 to cooperate with the peripheral edge of one of the end faces of the rollers 58, or also a shoulder 177 carried by the rail 127 and cooperating with the inner face 178 of the crosspiece 134.

The invention is not of course limited to the examples described and shown.

The fast assembly and disassembly device could equip only the stripping plate 1 or only the table 101. The invention is applicable in particular to the so-called "velvet" needling looms wherein the needling table is replaced by an endless circulating brush, in which case only the stripping plate can be assembled and disassembled as described in the context of this invention. The invention is also applicable to double-acting needling looms, where the textile web is needled through each of its surfaces between two plates, which have a stripping plate function, to which is optionally added a needling table function for the needles coming from the opposite side. The invention is also applicable to the needling carried out solely from the bottom or also to the needling carried out on a textile web moving in a non-horizontal plane, for example, in a vertical plane by means of needles driven with a horizontal reciprocating motion, through plates disposed in vertical planes.

The pressers are not necessarily produced in the form of levers; they could, for example, be constituted like sliding jacks, actuated by a piston or by an inflatable tube system of the type that was described above. They could also be grouped mechanically in order to be connected all together to a single actuating means common to several pressers.

It would also be possible to replace the inflatable tubes by actuating bars extending parallel with the rail and carrying cams disposed such that they simultaneously actuate the presser levers.

FIG. 1 shows, in the example of the modules 138, that the modules can be fixed to the frame 124 by their face opposite to the one facing the crosspiece 134 with which the rail 127 cooperates.

What is claimed is:

1. A fast assembly and disassembly device for positioning a machine part (1, 101) in an operating position against support means (34, 134) provided on the machine, and selectively for releasing said part in order to allow mobility thereof, characterized by comprising:

guidance means (58, 158) allowing insertion and extraction of the part (1, 101) into and out of the machine respectively;

pressers (37, 137) mounted to be movable with respect to a frame (16) of the machine, and capable of moving the part (1, 101) between the operating position and a preparatory position in which the part (101) is interacting with the guidance means (58, 158); and means (59, 61) of simultaneous control of the pressers.

2. A device according to claim 1, characterized in that the guidance means (58, 158) are sliding means.

3. A device according to claim 1, characterized in that the guidance means (58, 158) comprise bearer rollers (58, 158).

4. A device according to claim 1, characterized in that the pressers (137) comprise a fork (149, 158) between which a flange (131) integral with the part (101) protrudes with a certain vertical play, this fork being defined between a bearing face (152) in order to apply the part (101) selectively against an upward-facing reference face (133) of the support means (134) and a roller (158) located under a running surface of the part (101).

5. A device according to claim 1, characterized in that the pressers comprises a bearing face (52) for raising the part (1) against a downward-facing reference face (33) of the support means (34) and selectively for allowing the part (1) to drop back onto running rollers (58) integral with the frame (16).

6. A device according to claim 1, characterized in that the pressers (37, 137) are levers articulated with respect to the frame (16).

7. A device according to claim 1, characterized in that the control means comprise at least one selectively inflatable tube (59) inserted between an actuating face (55) of the pressers (37) on one side of the tube and a reactive bearing surface (39) on the other side of the tube.

8. A device according to claim 7, characterized in that each presser (37, 137) has a second actuating face (60), and the control means comprise a second tube (61) that can selectively be deflated and inflated respectively.

9. A device according to claim 1, characterized by furthermore comprising means for locking (71, 171) the part (1, 101) in the operating position.

10. A device according to claim 9, characterized in that the locking means are pins (71, 171) simultaneously inserted within a bore (72, 172) in the part (1, 101) and a bore in the frame.

11. A device according to claim 1, characterized in that the part (1, 101) is in the form of a plate and the device cooperates with two regions of opposite edges (28) of the plate.

12. A needling loom comprising:

a frame (16);

a path for a textile product (3) to be needled;

at least one plate (1, 101) adjacent to a major face of the path;

at least one set of needles (8) connected to an actuating mechanism (11-14, 16-19, 21, 22) for reciprocating the needles (8) through the path and through orifices (26) in the plate, characterized by furthermore comprising at least one device for fast assembly and disassembly of the plate according to claim 1.

13. A needling loom according to claim 12, characterized in that said at least one plate comprises two plates (1, 101) located on either side of the path, and traversable by needles (8), and the at least one fast assembly and disassembly device comprises two such devices, each associated with one of the plates.

* * * * *